US009821182B2

(12) United States Patent
Chen

(10) Patent No.: US 9,821,182 B2
(45) Date of Patent: Nov. 21, 2017

(54) CONCEALED SPRINKLER HEAD COVER ADJUSTING DEVICE

(71) Applicant: PROTECTOR SAFETY IND., LTD., Taoyuan County (TW)

(72) Inventor: Jung-Wen Chen, Taoyuan County (TW)

(73) Assignee: PROTECTOR SAFETY IND., LTD., Taoyuan County (TW)

( * ) Notice: Subject to any disclaimer, the term of this patent is extended or adjusted under 35 U.S.C. 154(b) by 80 days.

(21) Appl. No.: 14/741,448

(22) Filed: Jun. 17, 2015

(65) Prior Publication Data

US 2015/0283414 A1 Oct. 8, 2015

Related U.S. Application Data

(63) Continuation-in-part of application No. 14/191,437, filed on Feb. 27, 2014.

(30) Foreign Application Priority Data

Nov. 19, 2013 (TW) ..... 102221573 U

(51) Int. Cl.

| | |
|---|---|
| ***A62C 37/12*** | (2006.01) |
| ***A62C 37/09*** | (2006.01) |
| ***A62C 35/68*** | (2006.01) |
| ***A62C 37/14*** | (2006.01) |

(52) U.S. Cl.

CPC ..... *A62C 37/09* (2013.01); *A62C 35/68* (2013.01); *A62C 37/14* (2013.01)

(58) Field of Classification Search

CPC .. A62C 37/12; A62C 3/06; A62C 3/00; A62C 31/02; A62C 37/10; A62C 37/109

USPC ..... 169/37, 57

See application file for complete search history.

(56) References Cited

U.S. PATENT DOCUMENTS

| | | | | |
|---|---|---|---|---|
| 3,393,746 | A * | 7/1968 | Hodnett | A62C 37/12 169/41 |
| 3,633,676 | A * | 1/1972 | Gloeckler | A62C 37/09 169/40 |
| 3,714,989 | A * | 2/1973 | Gloeckler | A62C 37/09 169/19 |
| 3,727,695 | A * | 4/1973 | Danton | A62C 37/08 169/37 |
| 3,756,321 | A * | 9/1973 | Gloeckler | A62C 37/09 169/40 |

(Continued)

*Primary Examiner* — Chee-Chong Lee

(74) *Attorney, Agent, or Firm* — Chun-Ming Shih

(57) ABSTRACT

A concealed sprinkler head cover adjusting device includes a valve body formed with a flow channel therein. Both sides of the valve body are formed with an opposing bar along the axial direction of the flow channel. A shell is clamped on the opposing bars and is formed with a first accommodating space. A bottom cover is fixed to the bottom of the shell and is inwardly concaved formed a second accommodating space. A restriction site is formed on the outer wall of the opposing bars along the axial direction of the flow channel, both sides of the shell are symmetrically formed with a guiding part and a plurality of clamping parts, and the guiding parts guide the opposing bars to allow the clamping parts adjust the clamping position on the restriction site, thereby adjusting the position of the valve body in the first and second accommodating spaces.

5 Claims, 3 Drawing Sheets

(56) References Cited

U.S. PATENT DOCUMENTS

| | | | | | |
|---|---|---|---|---|---|
| 3,783,947 | A | * | 1/1974 | Dix | A62C 37/12<br>169/40 |
| 3,998,273 | A | * | 12/1976 | Juliano | A62C 37/12<br>169/37 |
| 5,080,176 | A | * | 1/1992 | Polan | A62C 37/14<br>169/37 |

* cited by examiner

CONCEALED SPRINKLER HEAD COVER ADJUSTING DEVICE

TECHNICAL FIELD

The technical field relates to a structure of a concealed sprinkler head cover, particularly to a concealed sprinkler head cover adjusting device.

RELATED ART

The conventional fire sprinkler head can be classified as concealed type, semi-concealed type, and open type. The concealed type is to hide the sprinkler head and the connected fire water supply into the ceiling, and only a head cover is exposed outside the ceiling.

The head cover of the traditional concealed type sprinkler head is formed with internal threads, and the outer wall of the opposing bars on both sides of the valve body of the sprinkler head is formed with external threads. Through the engagement between the internal threads of the head cover and the external threads of the opposing bars, the head cover can be mounted to the valve body. However, the contact area between the head cover and the opposing bars of the frame is limited, and thus the head cover is easy to be shaken when it is subject to an external vibration. Thus, the mounting stability and robustness of the head cover with the opposing bars of the frame is inadequate.

In order to improve the assembling stability of the traditional head cover and the valve body, the Applicant of the present application has invented a clamping device of the sprinkler head cover as disclosed in Taiwan Patent Number M475971. In this invention, a restriction site is formed on the opposing bar on both sides of the valve body, and both ends of the head cover are symmetrically formed with a clamping part and a guiding part. The guiding part guides the opposing bar to clamp the clamping part on the restriction site. By clamping the guiding part on the opposing bar, the stability of assembling the head cover to the valve body can be improved.

Although the aforementioned patent can solve the stability problem, however, since the concealed type sprinkler head is disposed at the water outlet of the fire water supply, and the fire water supply is arranged according to the structure of the building, the distance between the water outlet of the fire water supply and the ceiling is different, which may results in significant and noticeable height differences between the head cover disposed on the concealed sprinkler head and the ceiling.

Please refer to FIGS. 1 and 2, the concealed sprinkler head accommodates the valve body 10*a* by a head cover formed by the shell 20*a* and the bottom cover 30*a*, and thus the sprinkler head can be hidden inside the ceiling 50*a* to improve the beauty of the living area. However, for those reasons stated above, the height of the water outlet 41*a* of the fire water supply 40*a* and the ceiling 50*a* is different according to the wiring design of the building, which results in the height of the shell 20*a* and the ceiling 50*a* can be changed accordingly. When the distance between the water outlet 41*a* and the ceiling 50*a* is h1 (as shown in FIG. 1), there is no significant height differences between the shell 20*a* and the ceiling 50*a* since the shell 20*a* is close to the surface of the ceiling 50*a* to keep a distance h3 between the shell 20*a* and the ceiling 50*a*. By contrast, when the distance between the water outlet 41*a* and the ceiling 50*a* is h2 (as shown in FIG. 2), a significant height differences h4 between the shell 20*a* and the ceiling 50*a* can be caused since the shell 20*a* is over-protruded to the surface of the ceiling 50*a*, which influences the whole beauty of the living area.

BRIEF SUMMARY

In order to overcome the aforementioned problems, an exemplary embodiment of the present invention provides a concealed sprinkler head cover adjusting device to solve the problem that the sprinkler head over protrudes to the ceiling to cause a height difference between the ceiling and the head cover, which is unsightly.

The preferred embodiment of the present invention provides a concealed sprinkler head cover adjusting device, which includes a valve body, a shell, and a bottom cover. The valve body is formed with a flow channel therein; the flow channel is formed with a valve opening at a surface of the valve body; a water valve and a heat-activated glass bulb against the water valve are blocked at the valve opening; both sides of the valve body are symmetrically formed with an opposing bar respectively along an axial direction of the flow channel; the opposing bars are used for holding the heat-activated glass bulb; a bottom of the opposing bars is inserted with a conduct pillar and a spoiler connected to the conduct pillar; the shell is formed as enclosed-circle shape and is clamped on the opposing bars and is disposed around the outer periphery of the heat-activated glass bulb; a first accommodating space is formed inside the shell; the bottom cover is formed as cup shape and is fixed to a bottom of the bottom cover; the bottom cover is inwardly concaved to form a second accommodating space communicating the first accommodating space; an outer wall of the opposing bars are respectively formed with a restriction site along the axial direction of the flow channel, both sides of the shell are symmetrically formed a guiding part and a plurality of clamping parts along the axial direction of the flow channel, the opposing bars clamp the shell via the guiding part to allow adjusting positions of the shell along the axial direction of the flow channel; clamping positions of the plurality of clamping parts on the restriction site are adjustable, and positions that the valve body, the conduct pillar, and the spoiler positioned in the first accommodating space and the second accommodating space are able to be adjusted accordingly.

Furthermore, in the concealed sprinkler head cover adjusting device according to the present invention, the first accommodating space and the second accommodating space are respectively formed along the axial direction of the flow channel. The restriction site is a plurality of V-shaped grooves arranged at interval, and the clamping parts are elastic hooks being able to adjust high/low clamping positions on the V-shaped grooves. In addition, the restriction site can also be a plurality of bead grooves arranged at interval, and the clamping parts are elastic beads being able to adjust high/low clamping positions on the bead grooves. In a preferred embodiment of the concealed sprinkler head cover adjusting device according to the present invention, the bottom cover is adhered to a bottom of the shell by a low temperature metal.

Compared to the conventional device, the advantages of the present invention lies in that: the shell can increase the range of the clamping position by the plurality of clamping parts, and a second accommodating space communicating the first accommodating space is formed in the bottom cover to increase the space in the shell for accommodating the valve body. Compared to the shell of the traditional sprinkler head, the moving range of the shell when covering the valve body can be increased, and the shell can be much closer to the ceiling, which decreases the height difference between the shell and the ceiling, thereby improving the beauty of the exterior.

Besides, the detailed description of the preferred embodiment of the present invention will be described in the following paragrapghs.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
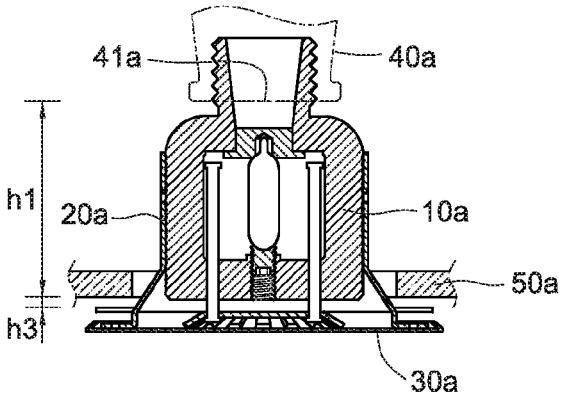
Fig. 1 (Related Art)
FIG. 1 is an assembling longitudinal sectional view of a traditional sprinkler head and head cover of a preferred embodiment in the present invention.
Figure 2:
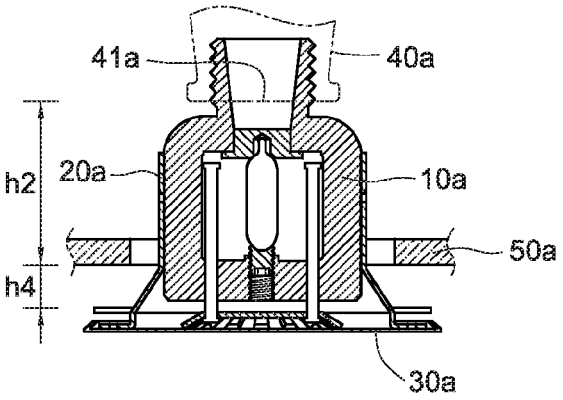
Fig. 2 (Related Art)
FIG. 2 is another assembling longitudinal sectional view of a traditional sprinkler head and head cover of a preferred embodiment in the present invention.
Figure 3:
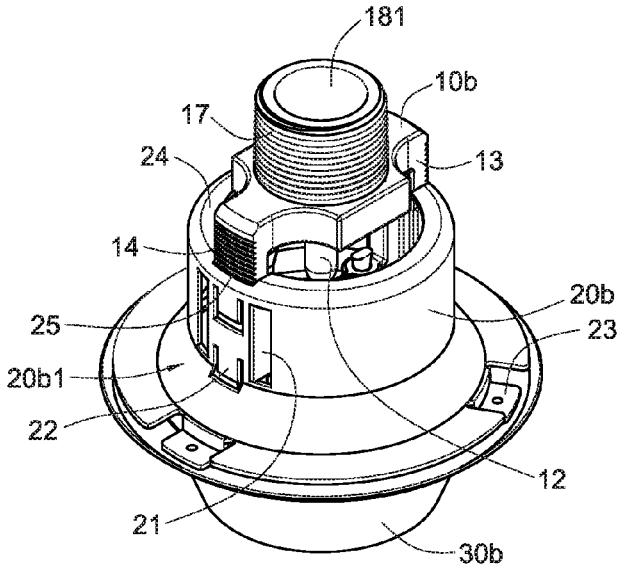
FIG. 3 is a perspective schematic view of a preferred embodiment of a concealed sprinkler head cover adjusting device according to the present invention.
Figure 4:
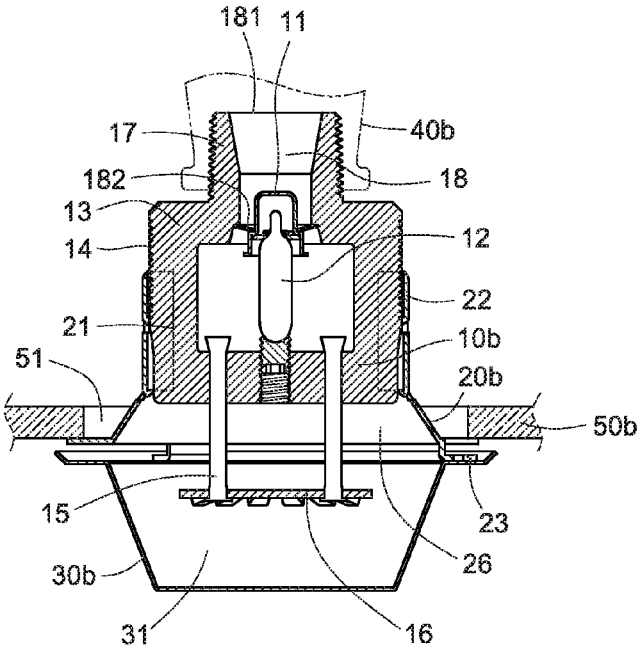
FIG. 4 is a sectional view of FIG. 3.

Refer to FIGS. 3 and 4, the concealed sprinkler head cover adjusting device includes a valve body 10*b*, a shell 20*b*, and bottom cover 30*b*.

The valve body 10*b* in formed with a screwing part 17 on the top thereof. The valve body 10*b* can be connected to a fire water supply 40*b* via the screwing part 17, and is exposed to the living area via a through hole 51 of the ceiling 50*b*. A flow channel 18 is formed inside the valve body 10*b*, and both ends of the flow channel 18 are respectively formed a water inlet 181 and a valve opening 182 at the surface of the valve body 10*b*. The flow channel 18 communicates with the fire water supply 40*b* via the water inlet 181 to allow the water in the fire water supply 40*b* flowing into the flow channel 18 from the water inlet 181 and flowing out of the flow channel 18 through the valve opening 182. The valve opening 182 is blocked by a water valve 11. The water valve 11 can control the timing of supplying water from the fire water supply 40*b*. A heat-activated glass bulb 12 is disposed at the bottom of the water valve 11. The heat-activated glass bulb 12 is against the water valve 11 to close the valve opening 182 in normal condition, which can prevent the water in the fire water supply 40*b* from coming out. Both sides of the valve body 10*b* are symmetrically formed with an opposing bar 13 along the axial direction of the flow channel 18. The opposing bars 13 are used to position the heat-activated glass bulb 12 into the valve body 10*b*. A bottom of the opposing bars 13 is inserted with a conduct pillar 15 which is able to slide along the axial direction of the flow channel 18. The conduct pillar 15 is connected to a plate-shaped spoiler 16 which can make the water coming out form the valve opening 182 a fan-shaped water curtain, thereby increasing the water spreading area.

The shell 20*b* is formed as enclosed-circle shape, and a first accommodating space 26 is formed inside the shell 20*b*. A top of the shell 20*b* extends inwardly to form a ring-shaped neck 24 communicating the first accommodating space 26. The ring-shaped neck 24 is formed with assembly grooves 25 symmetrically correspond to each other. The inner diameter of the ring-shaped neck 24 is smaller than the outer diameter of the valve body 10*b*, and the inner diameter between the two assembly grooves 25 is larger than the outer diameter of the valve body 10*b*, thereby restricting the assembling method of the valve body 10*b* and the shell 20*b*. The shell 20*b* is guided to be clamped on the valve body 10*b*. The valve body 10*b*, the conduct pillar 15, and the spoiler 16 are thus accommodated into the first accommodating space 26. The bottom of the shell 20*b* expands outwardly to form a ring-shaped bonding portion 23.

The shell 20*b* is clamped on the opposing bars 13 on both sides of the valve body 10*b* to position the valve body 10*b* into the first accommodating space 26. Specifically, both ends 20*b*1 of the shell 20*b* are respectively and symmetrically formed a guiding part 21 and a plurality of clamping parts 22. An outer wall of the opposing bars 13 is formed with a restriction site 14. The opposing bars 13 can restrict the moving direction of the shell 20*b* by the guiding part 21, and the position of the shell 20*b* can only be adjusted along the axial direction of the flow channel 18, thereby adjusting the position of the valve body 10*b* in the first accommodating space 26. The guiding part 21 can be a tongue integrally stamped from the shell 20*b* and being curved to the radical direction of the flow channel 18. The opposing bars 13 and the shell 20*b* can restrict the shell 20*b* to move along the axial direction of the flow channel 18 by the guiding part 21. The clamping part 22 can adjust the clamping position on the restriction site 14 to further adjust the position of the valve body 10*b* in the first accommodating space 26. The clamping part 22 can be a hook or an elastic tongue which are being able to adjust the clamping position on the restriction site 14. More specifically, the plurality of clamping parts 22 are formed on the outer wall of the shell 20*b* along an axial direction of the flow channel 18. The clamping area on the valve body 10*b* of the shell 20*b* can be expanded by using the plurality of clamping parts 22, and thus the shell 20*b* can be much closer to the surface of ceiling 50*b*, thereby decreasing the distance between the ceiling 50*b* and the shell 20*b*. Therefore, the noticeable distance between the ceiling 50*b* and the shell 20*b* can be minimized, and the beauty of the living area can be improved as well.

The bottom cover 30*b* is fixed to the bottom of the shell 20*b*. More specifically, the bottom cover 30*b* is adhered to a bonding portion on the bottom of the shell 20*b* by a low melting point metal (such as Tin). When the high temperature caused by the fire melts the low melting point metal, the bottom cover 30*b* can fall down from the shell 20*b*, and the hot air can enter into the shell 20*b* to heat up and break the heat-activated glass bulb 12, thereby opening the water valve 11 to spread water.

The bottom cover 30*b* is formed as cup shape, and the bottom cover 30*b* is inwardly concaved to form a second accommodating space 31. The second accommodating space 31 is fixed to the bottom of the shell 20*b* via the bottom cover 30*b* to communicate with the first accommodating space 26. The first accommodating space 26 and the second accommodating space 31 are formed along the axial direction of the flow channel 18. The valve body 10*b* is able to adjust the clamping position on the restriction site 14 by the clamping part 22. Thus, the valve body 10*b*, the conduct pillar 15, the spoiler 16 can be positioned in the first accommodating space 26, or the first accommodating space and the second accommodating space 31 along the axial direction of the flow channel 18.

Figure 5:
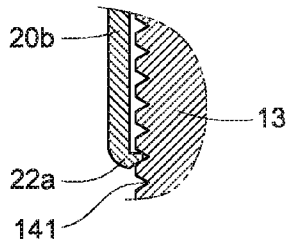
FIG. 5 is a partially magnified view of the clamping part and the restriction site in the first preferred embodiment of FIG. 4.

Refer to FIG. 5, the restriction site 14 can be formed by a plurality of V-shaped grooves 141 arranged at interval on the opposing bars 13. Specifically, the V-shaped grooves 141 are formed as tooth shape, and the clamping part 22 can be an elastic hook 22*a* formed by stamping the outer wall of the shell 20*b*. One end of the elastic hook 22*a* curves inwardly to be clamped inside the V-shaped groove 141. Thus, the clamping position of the shell 20*b* on the valve body 10*b* can be adjusted.

Figure 6:
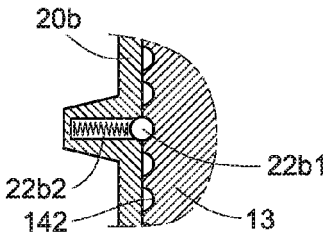
FIG. 6 is a partially magnified view of the clamping part and the restriction site in the second preferred embodiment of FIG. 4.

Refer to FIG. 6, the restriction site 14 can be formed by a plurality of bead grooves 142 arranged at interval. The clamping part 22 can use an elastic bead 22*b*1 to be clamped inside the bead grooves 142 by being pressed by a resilient component 22*b*2. Thus, the clamping position of the shell 20*b* on the valve body 10*b* can be adjusted.

Figure 7:
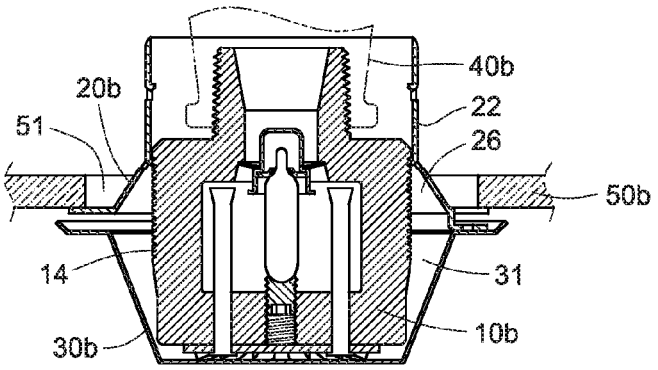
FIG. 7 is a sectional view of the concealed sprinkler head cover adjusting device of another preferred embodiment of the present invention.

Refer to FIG. 7, when the valve body 10*b* is protruded from the ceiling 50*b*, by adjusting the clamping position on the restriction site 14 of the clamping part 22 of the shell 20*b*, the shell 20*b* can be closer to the ceiling 50, which can minimize the height difference between the shell 20*b* and the ceiling 50*b* caused by over-protruding of the valve body 10*b*, thereby improving the beauty of the living area.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A concealed sprinkler head cover adjusting device, comprising:

a valve body formed with a flow channel therein, the flow channel being formed with a valve opening at a surface of the valve body, a water valve and a heat-activated glass bulb against the water valve being blocked at the valve opening, two opposite sides of the valve body symmetrically being formed with two opposing bars respectively along an axial direction of the flow channel, the two opposing bars being used for holding the heat-activated glass bulb, a bottom of each of the two opposing bars being inserted with a conduct pillar, and a spoiler being connected to the two conduct pillars;

a shell formed as enclosed-circle shape and being clamped on the two opposing bars and being disposed around an outer periphery of the heat-activated glass bulb, a first accommodating space being formed inside the shell;

a bottom cover formed as cup shape and being fixed to a bottom of the shell, the bottom cover being inwardly concaved to form a second accommodating space communicating the first accommodating space;

wherein an outer wall of each of the two opposing bars is formed with a restriction site along the axial direction of the flow channel, each of two opposite sides of the shell is symmetrically concaved to form a concave part consisting of a guiding part and a plurality of clamping parts along the axial direction of the flow channel, each of the two opposing bars clamps the shell via the guiding part to allow adjusting positions of the shell along the axial direction of the flow channel, wherein cross sections of each of the two opposing bars and each of the two concave parts are substantially formed in rectangle shape and fitted with each other, and the guiding part is substantially perpendicular to the plurality of clamping parts, and wherein the plurality of clamping parts have a plurality of clamping positions, and the plurality of clamping positions of the plurality of clamping parts on the restriction site are adjustable, so that positions of the valve body, the two conduct pillars, and the spoiler positioned in the first accommodating space and the second accommodating space are adjusted accordingly.

2. The concealed sprinkler head cover adjusting device according to claim 1, wherein the first accommodating space and the second accommodating space are respectively formed along the axial direction of the flow channel.

3. The concealed sprinkler head cover adjusting device according to claim 1, wherein the restriction site is a plurality of V-shaped grooves arranged at interval, the clamping parts are elastic hooks being able to adjust high/low clamping positions on the plurality of V-shaped grooves.

4. The concealed sprinkler head cover adjusting device according to claim 1, wherein the restriction site is a plurality of bead grooves arranged at interval, the clamping parts are elastic beads being able to adjust high/low clamping positions on the bead grooves.

5. The concealed sprinkler head cover adjusting device according to claim 1, wherein the bottom cover is adhered to a bottom of the shell by a low melting point metal.

* * * * *